US006361248B1

(12) United States Patent
Maestro

(10) Patent No.: US 6,361,248 B1
(45) Date of Patent: Mar. 26, 2002

(54) STORMWATER DISPENSING CHAMBER

(76) Inventor: Robert M. Maestro, 12301 Beechnut Ct., Woodbridge, VA (US) 22192-2002

( * ) Notice: Subject to any disclaimer, the term of this patent is extended or adjusted under 35 U.S.C. 154(b) by 0 days.

(21) Appl. No.: 09/645,269

(22) Filed: Aug. 25, 2000

(51) Int. Cl.[7] ..... E02B 13/00; E02B 11/00

(52) U.S. Cl. ..... 405/49; 405/48; 405/46; 138/105; 138/121

(58) Field of Search ..... 405/36, 43–46, 405/48, 49; 210/170, 747, 532.1; 138/105, 121, 173

(56) References Cited

U.S. PATENT DOCUMENTS

| | | | | | |
|---|---|---|---|---|---|
| 980,442 | A | * | 1/1911 | Schlafly | 405/48 |
| 3,374,634 | A | * | 3/1968 | Fochler | 405/49 |
| 4,759,661 | A | | 7/1988 | Nichols et al. | |
| 4,824,287 | A | | 4/1989 | Tracy | |
| 5,017,041 | A | | 5/1991 | Nichols | |
| 5,058,934 | A | * | 10/1991 | Brannon | 138/121 X |
| 5,087,151 | A | | 2/1992 | DiTullio | |
| 5,129,758 | A | | 7/1992 | Lindstrom | |
| 5,156,488 | A | | 10/1992 | Nichols | |
| 5,336,017 | A | | 8/1994 | Nichols | |
| 5,401,116 | A | | 3/1995 | Nichols | |
| 5,401,459 | A | | 3/1995 | Nichols et al. | |
| 5,419,838 | A | | 5/1995 | DiTullio | |
| 5,441,363 | A | | 8/1995 | Gray | |
| 5,511,903 | A | | 4/1996 | Nichols et al. | |
| 5,556,231 | A | | 9/1996 | Sidaway et al. | |
| 5,588,778 | A | * | 12/1996 | Nichols et al. | 405/48 |
| 5,890,838 | A | | 4/1999 | Moore, Jr. et al. | |

* cited by examiner

*Primary Examiner*—David Bagnell
*Assistant Examiner*—Sunil Singh
(74) *Attorney, Agent, or Firm*—Norman B. Rainer

(57) ABSTRACT

An elongated plastic chamber utilized for disposal of stormwater has a corrugated wall structure having successive peaks and valleys. The peaks and valleys are connected by upstream and downstream web panels. A series of apertures is disposed in the upstream web panels. The associated facing downstream web panel is smoothly integrated with the corresponding valley to form a curved surface which is concave with respect to the associated peak and serves to deflect outwardly from the chamber water emergent from the apertures. The effect of the interaction of the apertures with the curved surface is to minimize deposition of sediment within the chamber.

10 Claims, 5 Drawing Sheets

STORMWATER DISPENSING CHAMBER

BACKGROUND OF THE INVENTION

1. Field of the Invention

The present invention relates to the conveyance, storage and disposal of stormwater runoff, and more particularly concerns chambers which facilitate the infiltration of water into underlying substrate and minimize sediment maintenance requirements.

2. Description of the Prior Art

Culverts, catch basins, storm sewers and out falls are the common practices for handling, conveying and storing stormwater run-off. In some instances such water is discharged directly into the nearest available water body despite the potentially adverse environmental effects of such action. In some other instances, retention or detention basins/ponds are constructed to retain/detain the run-off. Retention and detention basins/ponds represent the most common structural approach to stormwater management. Although more environmentally sound then direct discharge into an existing water body, such stormwater management approaches preclude other uses of the land. This is of particular importance where land values are high and/or space is limited. The open ponds may also be undesirable in locations near airports because of birds attracted by the pond, or in locations where health, liability or aesthetic considerations make them undesirable. Even the use of "dry" detention basins frequently results in the same types of problems associated with wet ponds. Without proper maintenance, dry detention basins frequently transform into wet ponds.

Underground systems have also been developed for the storage and disposal of stormwater and/or sewage system effluent. Those systems most commonly used specifically for stormwater include large diameter pipe with a partial closing at the end to retard flow for sediment deposition; infiltration trenches, which are basically excavations filled with stone; and sand filters—typically large, partitioned concrete "boxes" with an initial compartment for sediment deposition and a following compartment with sand and under-drains for stormwater filtration. Those commonly used for either stormwater or sewage system effluent are limited to plastic, arch-shaped, open bottom, "infiltration" chambers, the basis of the present invention. Although in limited use for approximately 10 years, the use of plastic stormwater chambers for this purpose is a relatively novel approach. Plastic stormwater chambers are also highly preferable to other types of stormwater management systems for other reasons: they are less expensive than other types of underground stormwater management devices; they are more maintenance "friendly"; longer lived; and unlike some other types of underground stormwater management facilities, can be located under paved areas. However, all current underground stormwater management systems are limited by the amount of area available for their installation.

In a typical installation, elongated hollow plastic chambers are emplaced in the ground to form a leaching field for receiving such waters and dispensing them into the surrounding earth. Such chambers have a central cavity for receiving inflow water. An open bottom, and apertures in the sides of the chamber provide the means whereby the water is allowed to exit the central cavity and disperse into the surrounding earth. The chambers are usually attached endwise to form long rows which may extend in side-by-side juxtaposition. For stormwater applications, the assemblage of chambers is generally engulfed in coarse backfill such as gravel or rock and overlying compacted soil to the surface or to a paved cover surface. The resultant installation may be used as a parking lot, roadway, sports field or for other uses.

In order to sustain the considerable downward forces imposed by the surrounding backfill and overhead vehicular traffic, the chambers are generally of arch-shaped configuration having a corrugated construction. The corrugations consist of a continuous sequence of ridges or peaks separated by valleys. The peaks and valleys are connected by web portions disposed in planes substantially orthogonal to the axis of elongation of the chamber.

Examples of such leaching chambers wherein the apertures in the sidewall are horizontal slots disposed in the peak and valley portions of the corrugations are disclosed in U.S. Pat. Nos. 5,017,041; 5,156,488; 5,336,017; 5,401,116; 5,441,363 and 5,556,231. Such leaching chambers generally have a geometrical configuration which permits nesting, thereby facilitating shipping and storage.

U.S. Pat. No. 5,511,903 discloses a corrugated leaching chamber wherein horizontal slot apertures are disposed not only in the peak and valley portions, but also in the web portions. Although a high total aperture area in the chamber sidewall facilitates the exit of water, it may also produce an undesired reduction in the strength of the chambers with respect to crushing.

New Federal stormwater regulations require state and local governments to lessen the pollutant levels in waterways, tributaries, lakes and ponds. As a result of these regulations, states and municipalities have to address ways to improve the quality of stormwater discharges. Some states and municipalities have recently completed, are in the process of completing, or plan to complete, revised Stormwater Manuals to satisfy this need. The primary targeted pollutants are sediment and nutrients (predominantly phosphorous and nitrogen).

Studies on stormwater effluent have documented that stormwater management facilities that infiltrate stormwater into the surrounding earth provide for the highest level of stormwater quality enhancement than any other type of stormwater management practice. This becomes evident when considering that a stormwater chamber system simply functions as a septic drain field for stormwater. A biomat of various microbial organisms forms on the stone and soil beneath the open bottom chambers that metabolize pollutants carried by the stormwater. The pollutants that escape metabolism within the biomat are subject to metabolism by similar microorganisms as the stormwater moves downward through the soil profile, as well as filtration through the soil column. The sediment is deposited and some is filtered out through the soil column.

Stormwater may carry considerable amounts of suspended particulate material, commonly referred to as Total Suspended Solids (TSS), which eventually settles out as sediment. The accumulation of such sediment adversely affects the storage capacity of stormwater management facilities, decreasing their effective life. The effective life of such facilities can be extended with a maintenance program for sediment removal. Unfortunately, the maintenance program utilized for most such facilities is commonly referred to as "benign neglect". This problem has become so serious that some municipalities have recently imposed a stormwater maintenance "fee" on all property owners to help pay for private-sector stormwater facility maintenance. The "fee" has not been sufficient in some cases to provide this type of maintenance for all such facilities.

The accumulation of sediment is of particular concern with underground stormwater management facilities, including stormwater chamber systems. Unlike stormwater wet and dry ponds (the most commonly used types of stormwater management facilities), by the very nature of their design, sediment management of underground stormwater management facilities has historically been inherently more inconvenient and costly. Some types of underground stormwater management facilities have to be replaced in order to remove accumulated sediment. It is therefore preferable to have a stormwater chamber system that minimizes the accumulation of sediment within the chambers and that allows for more convenient and cost-effective sediment maintenance.

The addition of excessive nutrients, particularly phosphorous and nitrogen, into receiving bodies of water accelerates their aging, adversely effects aquatic habitats, depletes oxygen, causes excessive growth of aquatic plants, causes fish kills, etc. High concentrations of phosphorous and nitrogen commonly exist in stormwater runoff, particularly in urbanized and agricultural areas. Most of the nutrients in urbanized areas come from pet wastes and fertilization of lawns and gardens. In agricultural areas, principally from animal wastes and fertilizers applied to crops. Sediment maintenance is also the key to nutrient reduction from stormwater runoff. Most of the phosphorous and nitrogen (as well as many other pollutants) are found in stormwater as part of the sediment load.

The other major concern with infiltrative stormwater management facilities, including stormwater chambers, is their effectiveness in soils with limited infiltration capability. Most municipalities will not allow the use of infiltrative stormwater management facilities on sites with soils of limited infiltrative capacity. This can be accommodated utilizing layers of sand and gravel under the chambers, underlain with perforated drainage pipe, but this solution gets expensive.

The phenomenon of the settling of suspended sediment is time and velocity dependent. The faster a unit volume of water flows, the greater its carrying capacity of total suspended solids. Conversely, total suspended solids are deposited proportionally to the decrease in velocity of flow. This is clearly seen in rivers and streams where sediment is noticeably deposited along the inner bank of curves where the velocity of flow is significantly less than the corresponding outer bank. Similarly, when a stream of water changes its direction of flow, its velocity decreases, depositing sediment. The more pronounced the change in direction of flow, the more pronounced the deposition of sediment at that location.

In leaching chambers, the velocity of axial flow is greater than the velocity of transverse flow directed through apertures in the sidewall. Accordingly, suspended particles which are caused to said move transversely with respect to the flow axis in order to exit said apertures are induced to settle out within the chamber. Such action is undesirable. It is preferable to cause the suspended matter in the water to deposit in the region exterior to the chamber.

It is a primary object of the present invention to provide a stormwater dispensing chamber which accumulates reduced amounts of sediment derived from said stormwater.

It is a further object of this invention to provide a dispensing chamber as in the foregoing object which is nestable with other identical chambers.

It is another object of the present invention to provide a dispensing chamber of the aforesaid nature having apertures which do not significantly diminish the strength of the chamber.

It is a still further object of this invention to provide a dispensing chamber of the aforesaid nature which facilitates end-to-end joinder of said chambers.

It is yet another object of the present invention to provide a dispensing chamber of the aforesaid nature which is of monolithic construction amenable to low cost manufacture.

It is another object of the present invention to provide a dispensing chamber of the aforesaid nature which provides better predictability of sedimentation concentration within the chamber.

It is another object of the present invention to provide a dispensing chamber of the aforesaid nature which facilitates sediment removal.

It is another object of the present invention to provide a dispensing chamber of the aforesaid nature which provides better predictability of a sediment maintenance schedule.

It is another object of the present invention to provide a dispensing chamber of the aforesaid nature which facilitates the use of additional pollutant removal materials.

It is another object of the present invention to provide a dispensing chamber of the aforesaid nature having integral features that help restrict axial deformation.

It is another object of the present invention to provide a dispensing chamber of the aforesaid nature with integral features that facilitate their use in lieu of a header/manifold pipe for dispersion of aforementioned stormwater into the rows of a stormwater chamber system.

It is another object of the present invention to provide a dispensing chamber of the aforesaid nature which would provide enhanced water quality capabilities on sites that do not infiltrate well.

These objects and other objects and advantages of the invention will be apparent from the following description.

SUMMARY OF THE INVENTION

The above and other beneficial objects and advantages are accomplished in accordance with the present invention by an improved water dispensing chamber fabricated as a monolithic plastic structure elongated upon a straight axis between open inlet and exit extremities and having a wall of arch shape cross section defining an open bottom and having a multiplicity of alternating peaks and valleys running along the arch shape in planes orthogonal to said axis, and intervening portions which connect adjacent peaks and valleys, said intervening portions comprising facing upstream and downstream web panels embracing each valley wherein said upstream web panel is closer to said inlet extremity than the associated downstream web panel. In the improved dispensing chamber of this invention, the upstream web panels are provided with apertures which are preferably elongated in the direction of the arch shaped path of the web panel, and the downstream web panel is integral with the corresponding valley to form a curved impingement surface which serves to deflect outwardly from said chamber water emergent from said associated apertures.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
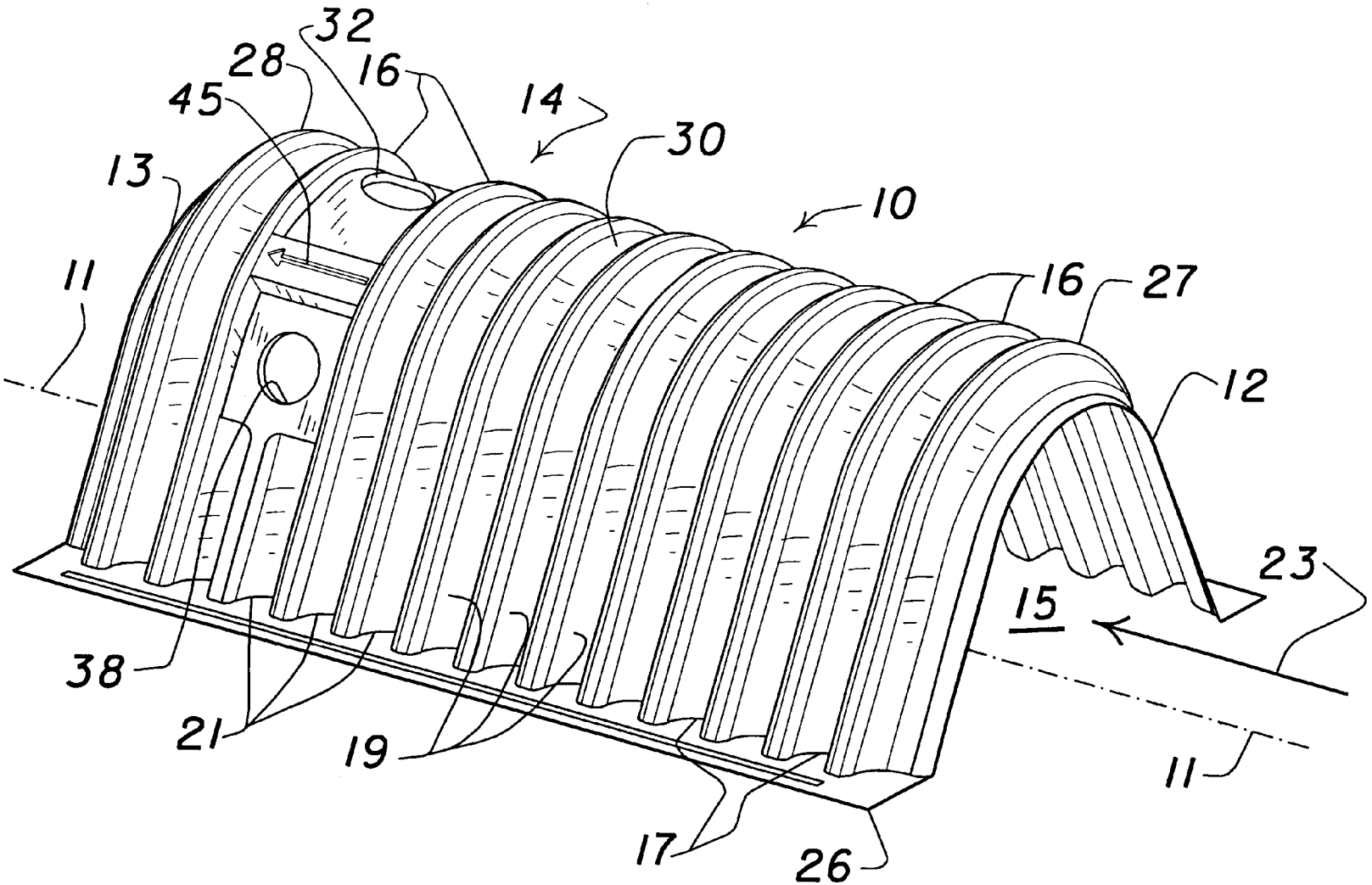
FIG. 1 is a front, side and top perspective view of an embodiment of the water dispensing chamber of the present invention.
Figure 2:
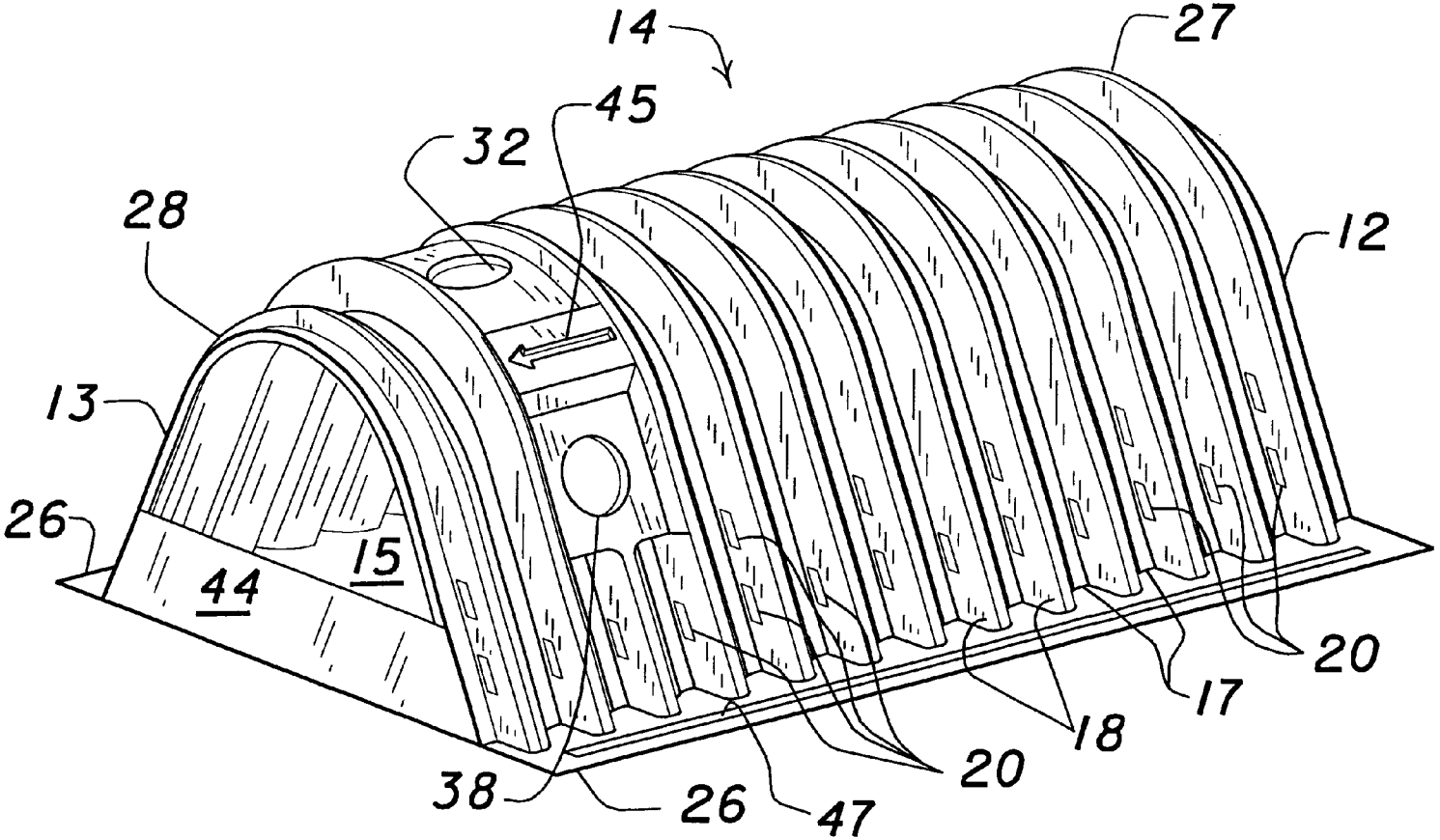
FIG. 2 is a rear, side and top perspective view of the chamber of FIG. 1.
Figure 3:
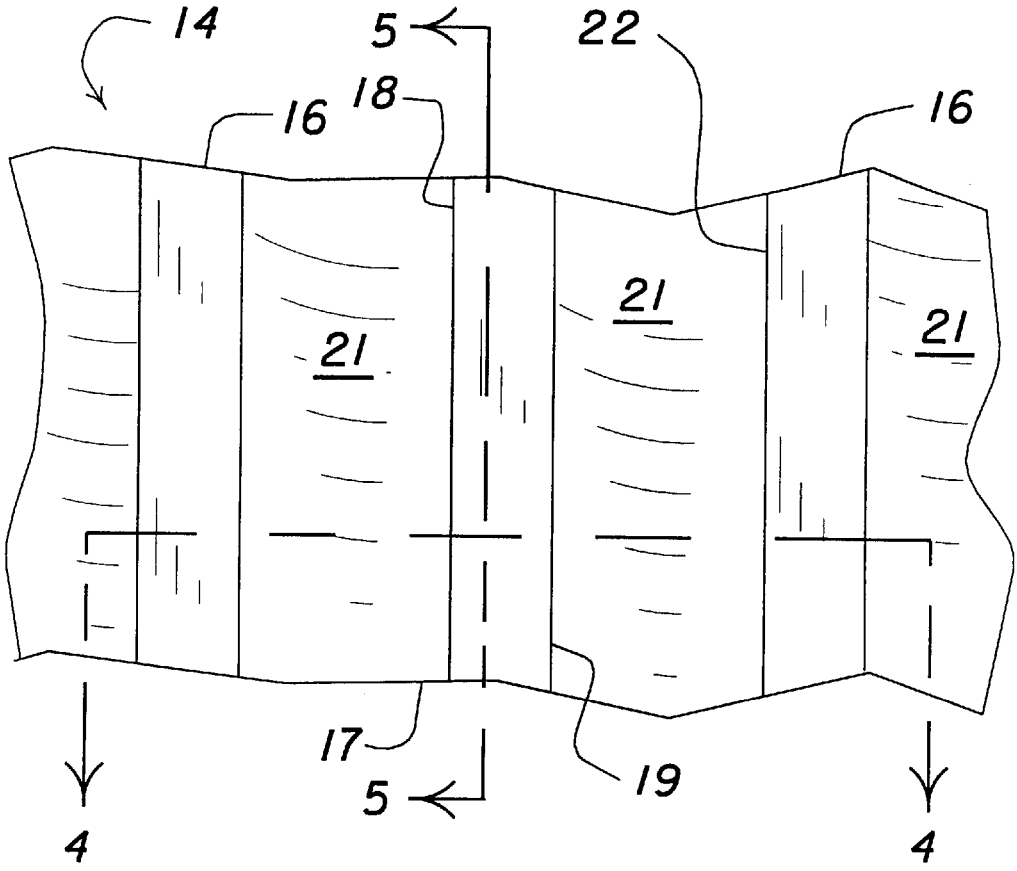
FIG. 3 is a fragmentary side view of the chamber of FIG. 1.

Referring now to FIGS. 1–7, an embodiment of the chamber 10 of the present invention is shown comprised of a monolithic plastic structure elongated upon straight axis 11 between open inlet and exit extremities 12 and 13, respectively.

Chamber 10 is comprised of a wall 14 having an arch shape cross section and defining an open bottom 15. Wall 14 has a multiplicity of alternating peaks and valleys 16 and 17, respectively running along the arch shape in planes orthogonal to said axis, thereby causing wall 14 to have a corrugated appearance. Adjacent peaks and valleys are connected by facing upstream and downstream web panels 18 and 19, respectively, embracing each valley 17. Said upstream web panel is closer to said inlet extremity than the associated facing downstream web panel.

Figure 4:
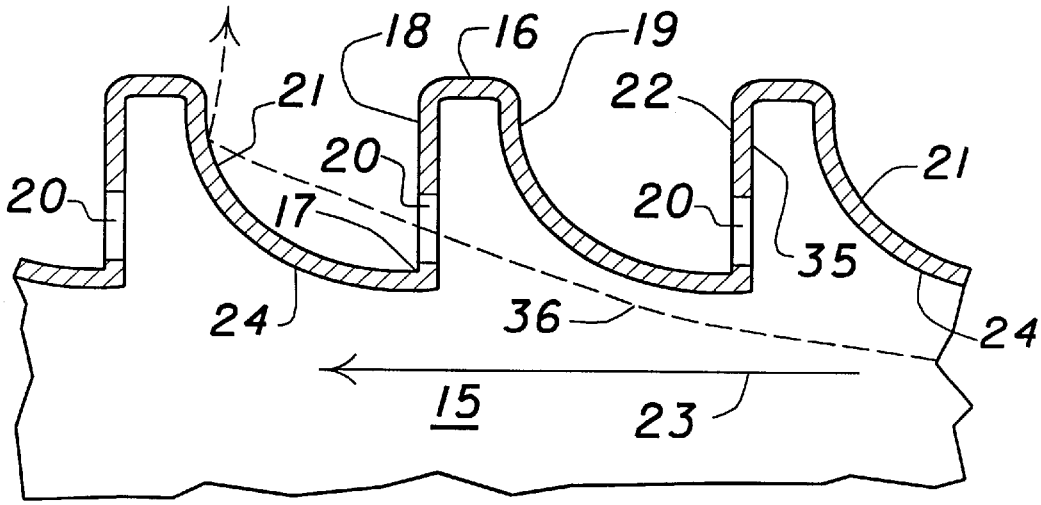
FIG. 4 is an enlarged sectional view taken in the direction of the arrows upon the line 4—4 of FIG. 3.
Figure 5:
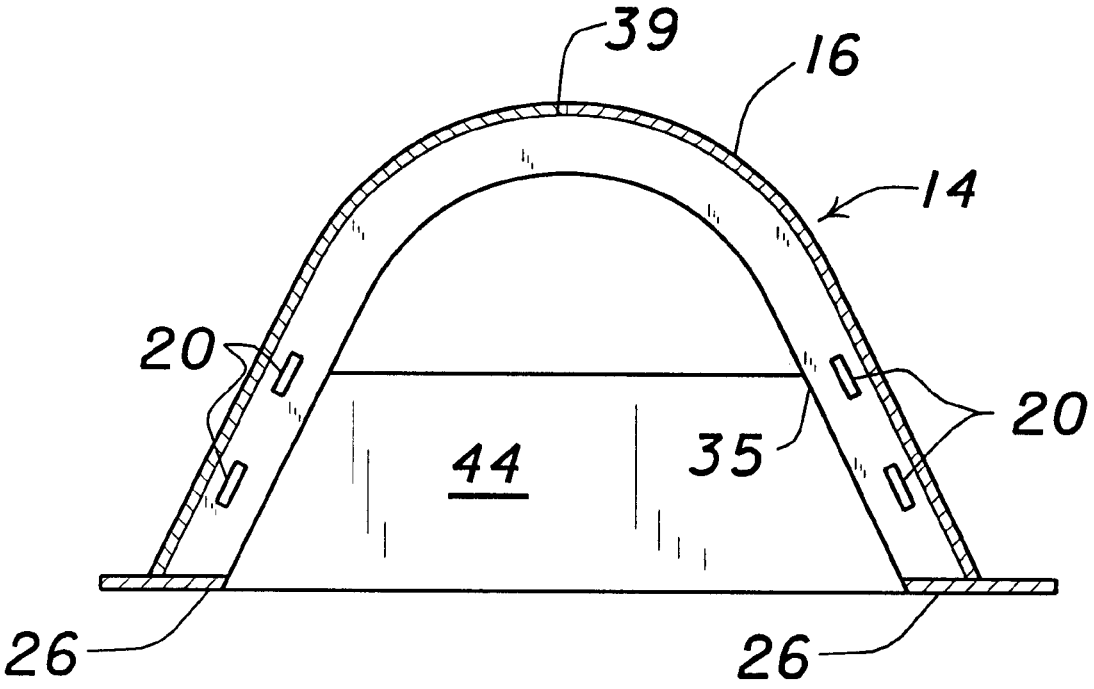
FIG. 5 is a vertical sectional view taken in the direction of the arrows upon the line 5—5 of FIG. 3.
Figure 7:
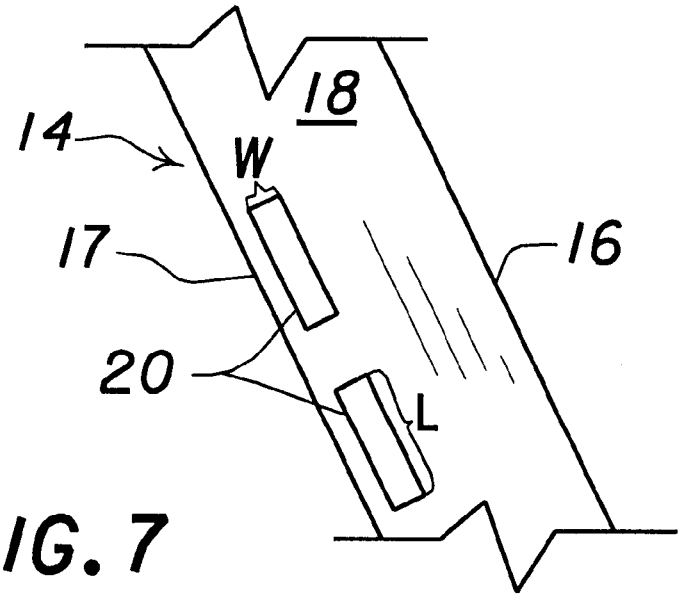
FIG. 7 is an enlarged fragmentary portion of FIG. 5.

As best shown in FIGS. 4, 5 and 7, apertures 20, communicating between the interior and exterior surfaces, 35 and 22, respectively of wall 14, are disposed in upstream web panels 18, said apertures being elongated in the direction of the arch shaped path of the web panel. Said apertures are positioned closely adjacent the associated valley, and occupy less than 25% of the distance between the valley and associated peak 16. Said apertures are preferably of elongated shape, having a rectangular, elliptical or other configuration characterized in being symmetrical with respect to a centered axis of elongation. Said apertures may occupy between 1% and 5% of the total surface area of each upstream web panel. Said apertures, when of elongated shape, may be characterized in having a length L and width W wherein the ratio of the length to width is preferably between 8 and 15. The spaces 42 between successive apertures are preferably between 5 and 12 times the width of said apertures. In preferred embodiments, said apertures are located only in the lower 50% of the height of wall 14, and the specific elevational locations of said apertures are staggered with respect to successive upstream web panels 18. Because of the critically selected characteristics and arrangement of said apertures, the compressive strength of the chamber is not significantly diminished.

Said downstream web panels are smoothly integrated with the corresponding valley to form a curved impingement surface 21 which is concave with respect to the immediately preceding upstream peak 16. The effect of impingement surface 21 is to receive a stream of water emergent from associated apertures 20, and deflect said stream outwardly from the chamber, said stream being represented by the broken line arrowed path 36 in FIG. 4. As further illustrated in FIG. 4, said stream of emergent water is substantially tangentially derived from the chamber's main flow of water, represented by solid arrowed line 23. It is important to note that the interiorly directed convex face 24 of impingement surface 21 serves to attract and hold emergent stream 36 by virtue of the well known Coanda principle of fluid dynamics. In view of such factors, the velocity of emergent stream 36 is substantially the same as the velocity of the main flow 23.

The chambers of the present invention are fabricated preferably of high density polyethylene by way of thermal vacuum forming or gas assisted injection molding techniques, generally in accord with the technology described in U.S. Pat. Nos. 5,401,459; 5,087,151; 4,247,515; 4,234,642; 4,136,220 and 4,101,617. The disclosures of the foregoing patents are hereby incorporated by reference. Thus, during molding, the plastic is configured to form a chamber having outwardly directed hollow ribs or corrugations. The chamber may however be fabricated in alternate ways. For example, it may be fabricated of structural foam, or made by conventional injection molding, etc. The wall thickness of the chamber may be uniform throughout or varied to achieve structural reinforcement in specific areas.

The chamber preferably has opposed axially elongated base panels 26 integral with the lowermost extremities of wall 14. Said base panels support the chamber, discouraging its descent into the underlying substrate. Base panels 26 also enhance the rigidity of the chamber and prevents divergent lateral movement of said lowermost wall extremities, particularly at the site of joinder of the terminal extremities of consecutive chambers. An upraised ridge 47 may extend the length of the base panels to impart further rigidity to the chamber.

The terminal or first rib or corrugation 27 adjacent inlet extremity 12 may be of larger dimensions than the terminal rib 28 adjacent exit extremity 13. Such configuration of the terminal ribs facilitates end-to-end joinder of successive chambers wherein vertical lowering of a chamber automatically causes the larger rib of one chamber to embrace the smaller rib of the next successive chamber. Other interactive means may be associated with said terminal ribs to prevent lateral expansion of the lowermost extremities of the chamber wall.

Figure 6:
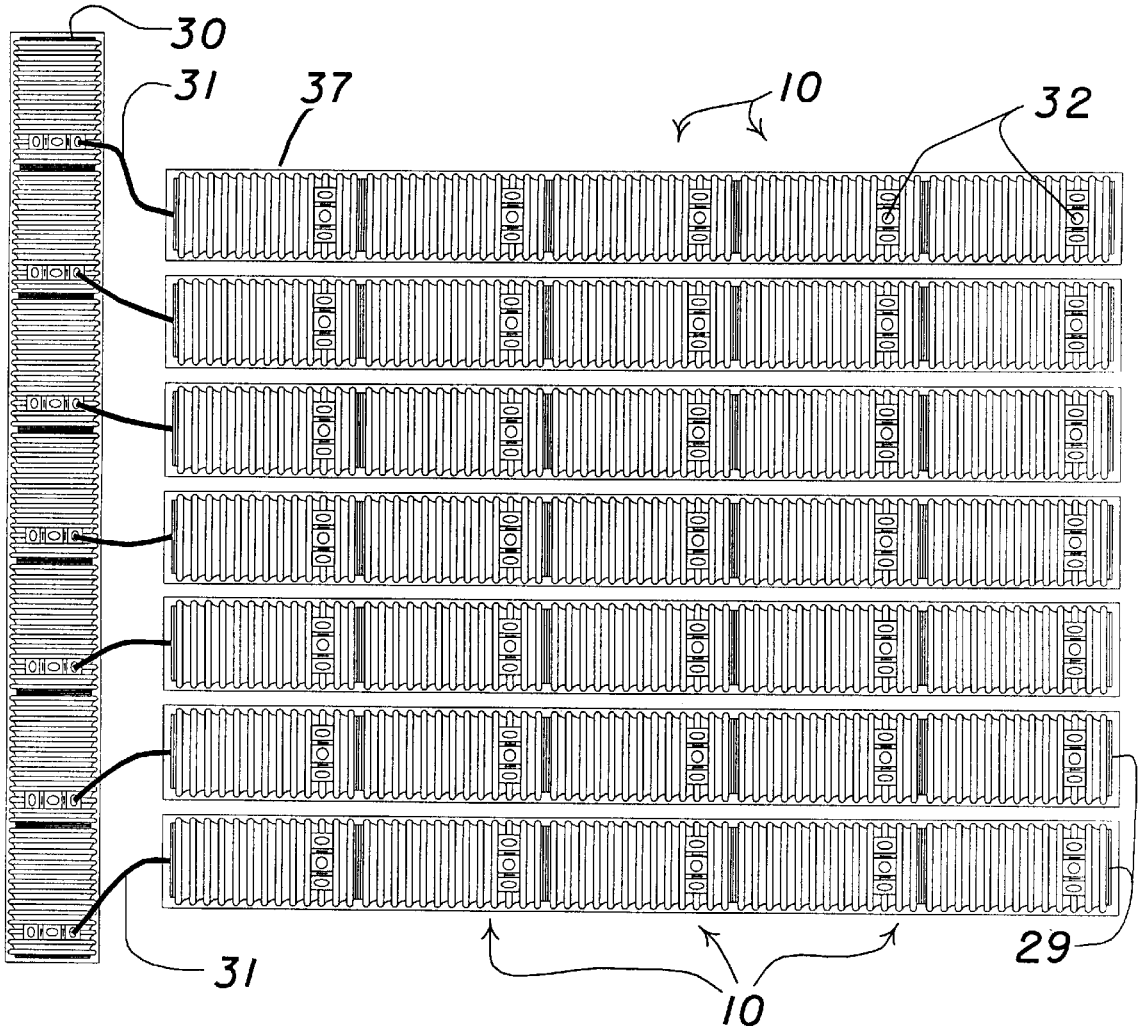
FIG. 6 is a schematic plan view of a multitude of chambers of FIG. 1 shown functionally emplaced in a drainage field.

In a typical installation, as shown in FIG. 6, a multitude of the chambers of the present invention are joined end-wise to form long rows 29. A multitude of such rows are in side-by-side juxtaposition, resting upon a crushed rock substrate. A feeder conduit 30 delivers the water to the drainage field, and smaller transfer conduits 31 convey the water to the upstream or inlet extremity of the first chamber 37 in the row, said first inlet extremity being closed by an end wall having an opening to receive conduit 31. The successive chambers in the row, subsequent to the first chamber, have a completely open upstream extremity. The downstream extremities of said chambers have a transverse panel 44, as shown in FIG. 5, positioned adjacent base panels 26. Said transverse panel functions to accumulate within a localized region of the chamber any sedimentary material that did not exit via apertures 20. The last chamber in the row has an end wall which is closed except for an opening to accommodate a discharge conduit.

Feeder conduit 30 may be comprised of a row of chambers 10 having side portals 38 interactive with transfer conduits 31. Alternatively, said feeder conduit may be a conventional corrugated metal or plastic pipe of large diameter. In other embodiments, inflow streams may be conducted directly to side portals 38 without utilization of a feeder conduit 30. Typical chambers of this invention may have a length of 6–12 feet and a height of 5–50 inches measured between base panel 26 and the top 39 of the arched wall. The width of the chamber, measured transversely to axis 11 in the plane of base panel 26, may range between 6 and 80 inches, including the width of said base panels.

A top portal 32 with closure means may be present to facilitate inspection and clean out. Portal 32 permits joinder with a vertical access conduit communicating with a manhole located at ground level above the chamber. Such arrangement facilitates removal of accumulated sediment by use of vacuum equipment. Portal 32 is preferably located close to exit extremity 13 so as to provide easier access to sediment concentrated adjacent transverse panel 44. Portals 32 may also be employed for the insertion and removal of absorbents capable of removing dissolved pollutants. Suitable adsorbents are those unaffected by suspended material and which provide little impedance to fluid flow. An example of such absorbent material, as disclosed in U.S. Pat. No. 5,597,850, is a sponge material which can be easily confined in a porous enclosure capable of vertical insertion into and removal from the chamber. Said portals and end walls may be provided with circular indentations to guide installing personnel in cutting out circles of proper diameter for insertion of interactive conduits. Side portals 38 are preferably axially displaced from top portals 32 along the length of the chamber so as not to adversely affect the strength of the chamber.

The assemblage of said rows of chambers is then covered with crushed rock or coarse gravel to the top of the chambers, covered with filter fabric of specified characteristics, and with soil to the surface or to a stone sub-base for a paved surface to complete the leaching field installation. An embossed arrow 45 may be present in the top middle region of the chamber wall to better enable workers to orient the chambers in proper end-to-end direction with respect to inlet and exit extremities.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. In a water dispensing chamber fabricated as a plastic structure elongated upon a straight axis between inlet and exit extremities and having a wall of arch shape cross section defining an open bottom and having a multiplicity of alternating peaks and valleys running along the arch shape in planes orthogonal to said axis and interconnected by facing upstream and downstream web panels wherein said upstream web panel is closer to said inlet than the associated downstream web panel, the improvement comprising:

a) a series of apertures disposed in said upstream web panels, and b) downstream web panels which are smoothly integral with each associated valley, forming a curved impingement surface which is concave with respect to the associated upstream peak, said impingement surface serving to deflect outwardly from said chamber water emergent from said associated apertures.

2. The chamber of claim 1 wherein said inlet and exit extremities are open.

3. The chamber of claim 1 being of monolithic construction.

4. The chamber of claim 3 wherein said apertures are elongated in the direction of the arch shaped path of said upstream web panels.

5. The chamber of claim 4 wherein said apertures have a length and width, the ratio of said length to width being between 8 and 15.

6. The chamber of claim 5 wherein the total area of said apertures is between 1% and 5% of the area of said web panel.

7. The chamber of claim 6 wherein the elevational locations of said apertures are staggered with respect to successive upstream web panels.

8. The chamber of claim 6 wherein said apertures are located only in the lower 50% of the height of said wall.

9. The chamber of claim 4 wherein successive apertures are spaced apart by a distance between 5 and 12 times the width of said apertures.

10. The chamber of claim 1 wherein the width of said apertures occupies less than 25% of the distance between said associated valley and the corresponding peak.

* * * * *